US010682875B2

(12) United States Patent
Paskalova

(10) Patent No.: US 10,682,875 B2
(45) Date of Patent: Jun. 16, 2020

(54) LASER ABLATION PRINTING

(71) Applicant: KYOCERA Document Solutions Inc., Osaka (JP)

(72) Inventor: Svetlana Paskalova, Torrance, CA (US)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/141,918

(22) Filed: Sep. 25, 2018

(65) Prior Publication Data

US 2020/0094602 A1 Mar. 26, 2020

(51) Int. Cl.
*B41M 5/24* (2006.01)
*B41M 1/12* (2006.01)

(52) U.S. Cl.
CPC ..... *B41M 5/24* (2013.01); *B41M 1/125* (2013.01); *Y10S 101/37* (2013.01); *Y10S 430/146* (2013.01)

(58) Field of Classification Search
CPC ..... B41M 5/24; B41M 1/125; Y10S 101/37; Y10S 430/146
See application file for complete search history.

(56) References Cited

U.S. PATENT DOCUMENTS

| | | | | |
|---|---|---|---|---|
| 3,402,659 | A * | 9/1968 | Johnson | B41M 1/125 101/129 |
| 3,463,884 | A * | 8/1969 | Norman | B41J 2/471 178/30 |
| 4,723,135 | A * | 2/1988 | Yano | B41J 2/295 347/20 |
| 5,429,909 | A | 7/1995 | Kaszczuk et al. | |
| 5,569,568 | A | 10/1996 | DeBoer | |
| 6,423,464 | B1 | 7/2002 | Kubo et al. | |
| 2009/0256897 | A1 * | 10/2009 | Polk | B41F 17/00 347/104 |
| 2010/0013880 | A1 * | 1/2010 | Polk | B41J 3/4073 347/9 |
| 2014/0009522 | A1 * | 1/2014 | Marcus | B41J 2/115 347/10 |

* cited by examiner

*Primary Examiner* — John Zimmermann
(74) *Attorney, Agent, or Firm* — McDonnell Boehnen Hulbert & Berghoff LLP

(57) ABSTRACT

A method for performing laser-ablation printing may include (i) determining an image to be printed on a printing substrate; (ii) ablating a printing material to expel a plurality of ablated printing material particles from a surface of the printing material; (iii) electrically charging the ablated printing material particles; and (iv) accelerating the electrically charged ablated printing material particles toward the printing substrate so that the accelerated particles are deposited on the printing substrate in a pattern that corresponds to the determined image.

20 Claims, 5 Drawing Sheets

LASER ABLATION PRINTING

BACKGROUND

In recent years, various types of printing devices have become popular for both business and consumer use. In addition to traditional black and white printers, color printers, scanners, copiers, fax machines, and other components are now common. Multi-function peripherals (MFPs) that support two or more of these functions are also widely available.

Among other functions, these printing devices are used to print graphics or text onto a printing surface, such as paper. Printing onto a printing surface may include, for instance, inkjet printing or laser printing processes.

It is desirable to improve on these arrangements or at least to provide one or more useful alternatives to help to improve printing processes.

SUMMARY

In one aspect, a method is described. The method may include (i) determining an image to be printed on a printing substrate; (ii) ablating a printing material to expel a plurality of ablated printing material particles from a surface of the printing material; (iii) electrically charging the ablated printing material particles; and (iv) accelerating the electrically charged ablated printing material particles toward the printing substrate so that the accelerated particles are deposited on the printing substrate in a pattern that corresponds to the determined image.

In a further aspect, a system is described. The system may include (i) a printing substrate; (ii) a printing material; (iii) a laser; (iv) a charging electrode; (v) electrostatic deflectors; (vi) one or more processors; and (vii) a non-transitory computer-readable medium having stored thereon program instructions that, upon execution by the one or more processors, cause performance of a set of operations. The set of operations may include (i) determining an image to be printed on the printing substrate; (ii) causing the laser to ablate the printing material, thereby expelling a plurality of ablated printing material particles from a surface of the printing material; (iii) causing the charging electrode to electrically charge the ablated printing material particles; and (iv) causing the electrostatic deflectors to accelerate the electrically charged ablated printing material particles toward the printing substrate so that the accelerated particles are deposited on the printing substrate in a pattern that corresponds to the determined image.

In a further aspect, another method is described. The method may include (i) receiving a digital image comprising a plurality of pixels; and (ii) for one or more pixels of the plurality of pixels, performing a laser-ablation printing process. The laser-ablation process may include (i) determining a color value of the one or more pixels; (ii) based on the determined color value of the one or more pixels, laser-ablating a particular printing material of a plurality of printing materials, thereby expelling a plurality of ablated printing material particles from a surface of the particular printing material; (iii) electrically charging the ablated printing material particles; and (iv) accelerating the electrically charged ablated printing material particles toward one or more locations on a printing substrate, wherein the one or more locations on the printing substrate are based on a position of the one or more pixels in the digital image.

These as well as other aspects, advantages, and alternatives will become apparent to those of ordinary skill in the art by reading the following detailed description with reference where appropriate to the accompanying drawings. Further, it should be understood that the description provided in this summary section and elsewhere in this document is intended to illustrate the claimed subject matter by way of example and not by way of limitation.

DETAILED DESCRIPTION

Figure 1:
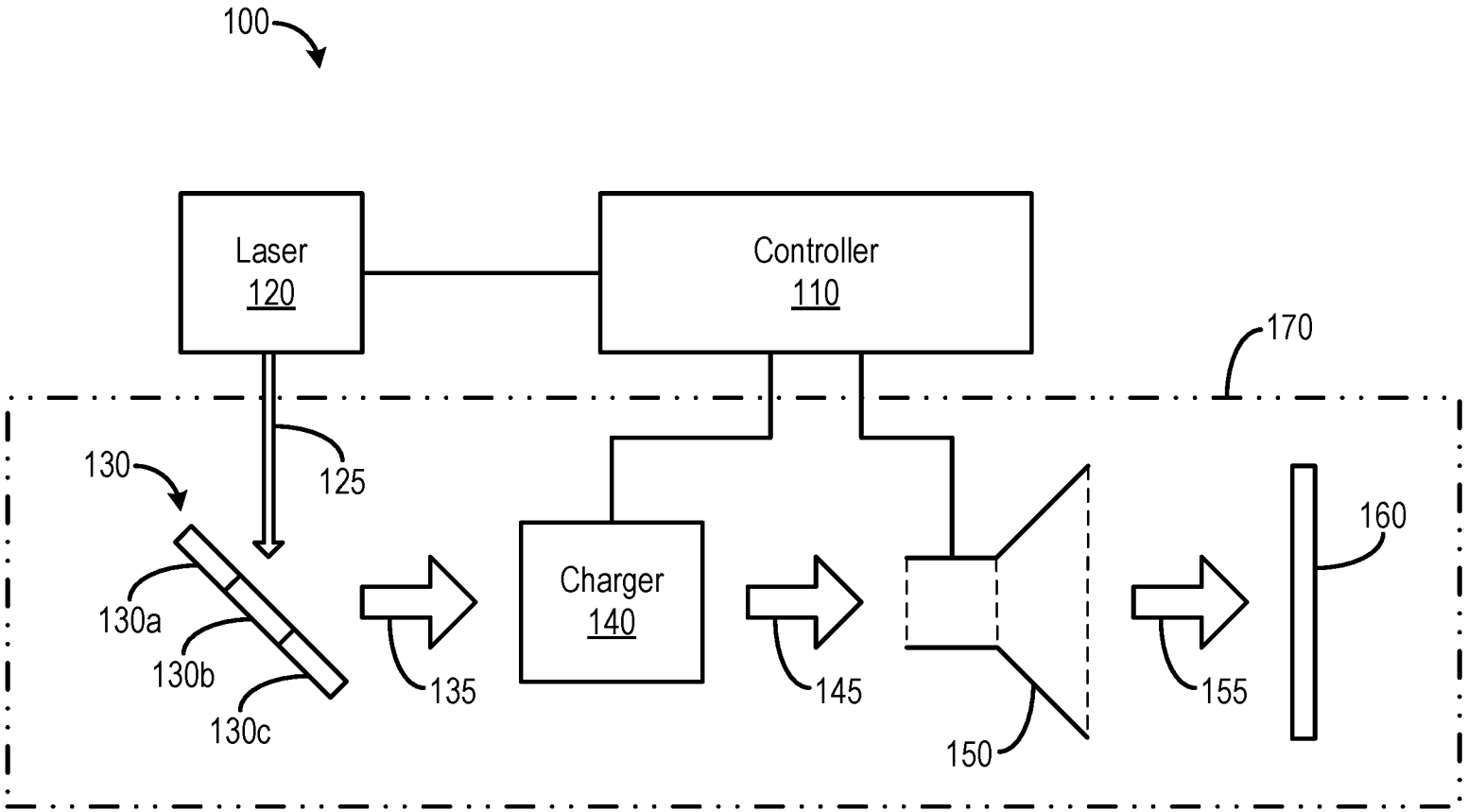
FIG. 1 is a simplified block diagram of a printing system, according to an example embodiment.

Example methods and systems are described herein. Other example embodiments or features may further be utilized, and other changes may be made, without departing from the scope of the subject matter presented herein. In the following detailed description, reference is made to the accompanying figures, which form a part thereof.

The example embodiments described herein are not meant to be limiting. Thus, aspects of the present disclosure, as generally described herein and illustrated in the figures, can be arranged, substituted, combined, separated, and designed in a wide variety of different configurations, all of which are explicitly contemplated herein.

Further, unless context suggests otherwise, the features illustrated in each of the figures may be used in combination with one another. Thus, the figures should be generally viewed as component aspects of one or more overall embodiments, with the understanding that not all illustrated features are necessary for each embodiment.

I. Overview

Illustrative embodiments relate to example printing systems and corresponding printing methods. The printing systems and methods may be used to generate prints using printing materials that are of a wide variety and have improved shelf life.

In example arrangements, a printing system may include a laser, a charger, and an accelerator/collimator. The laser may ablate a printing material, thereby expelling particles from the surface of the printing material. The charger may electrically charge the expelled particles. And the accelerator/collimator may collimate the charged particles into a beam and accelerate the particles toward a printing substrate in order to deposit the printing material particles on the substrate.

Using laser ablation to print on a substrate provides a number of improvements. One improvement is that laser ablation allows for a variety of different printing materials to be used in the printing process. For instance, the printing material may include any type of material that may be laser-ablated, including one or more of a ceramic material, a metallic material, an intermetallic material, and/or various liquids. Using such exotic or divers printing materials may allow for printing images that could not be printed using a traditional printer. For instance, by using an ultraviolet-reactive printing material, laser ablation printing may be used to create prints that are altered, or that can only be seen, when exposed to ultraviolet light. Other examples are possible as well. Further, certain printing materials may provide improved adhesion to the printing substrate, which may result in more durable prints.

Another improvement is that printing materials used in laser ablation may have a longer shelf life than traditional printer ink. The water in traditional printer ink may evaporate over time until the ink becomes too viscous to be used in a printer. However, with laser ablation, the printing material may be ablated regardless of its viscosity.

II. Example Systems and Methods

FIG. 1 depicts a block diagram of a printing system 100 according to an example embodiment. The printing system 100 includes a controller 110, a laser 120, a printing material 130, a charger 140, an accelerator/collimator 150, and a printing substrate 160. As shown, the controller 110 may be communicatively coupled to the laser 120, the charger 140, and the accelerator/collimator 150, and may cause the laser 120, the charger 140, and the accelerator/collimator 150 to perform some or all of the various operations described herein.

The laser 120 may take various forms. For instance, the laser 120 may include a pulsed laser configured to generate a laser beam in pulses having a particular duration and rate. For instance, the laser 120 may be configured to generate laser beam pulses having a duration of the order of milliseconds to femtoseconds. Alternatively, the laser 120 may include a continuous wave laser configured to generate a laser beam having a substantially constant output power over time. A frequency of the laser 120 may depend on a gain medium of the laser. For instance, the laser 120 may be a gas laser that uses $CO_2$ as the gain medium to generate a laser beam having a wavelength of 10.6 or the laser 120 may be a solid-state laser that uses Nd:YAG as the gain medium to generate a laser beam having a wavelength of 1064 nm or, by using frequency doubling, 532 nm. However, the laser 120 is not limited to these gain mediums and frequencies.

In operation, the controller 110 may cause the laser 120 to emit a laser beam 125 toward the printing material 130 in order to ablate a surface of the printing material 130. Laser ablation occurs when the laser beam 125 heats the surface of the printing material 130 enough to cause the printing material 130 to evaporate or sublimate. As such, whether the laser 120 includes a pulsed laser or a continuous wave laser, the optical power of the laser should be sufficiently high to evaporate or sublimate the surface of the printing material 130.

The printing material 130 can also take various forms. For instance, the printing material 130 may include one or more solid materials, such as a ceramic, a metal, or an intermetallic material, and/or the printing material 130 may include one or more liquid materials. Ceramic materials may include inorganic, non-metallic materials, such as crystalline oxide, nitride, or carbide materials. Intermetallic materials may include compounds exhibiting metallic bonding and an ordered crystal structure.

As shown in FIG. 1, the printing material 130 may include multiple types and/or colors of printing material identified respectively as printing materials 130*a-c*. For instance, printing material 130*a* may be a ceramic material, printing material 130*b* may be an intermetallic material, and printing material 130*c* may be a metallic material. Additionally or alternatively, printing material 130*a* may have a first distinct color, printing material 130*b* may have a second distinct color, and printing material 130*c* may have a third distinct color. While the printing material 130 is shown as including three different types and/or colors of printing materials 130*a-c*, in other examples, the printing material 130 may include additional or fewer types and/or colors of printing materials 130*a-c*.

When the laser beam 125 irradiates the printing material 130, a number of ablated printing material particles are expelled from the surface of the printing material 130, as depicted by arrow 135. The ablated printing material particles may then advance to the charger 140. For instance, the charger 140 may be arranged proximate to the printing material 130 so that the ablated printing material particles are expelled toward the charger 140 as a result of the ablation.

The charger 140 may be configured to transfer an electrical charge to the ablated printing material particles, and the charger 140 may do so in various ways, such as by exposing the printing material particles to an RF discharge, a microwave discharge, an ion or electron beam, a dielectric barrier discharge, or a corona discharge. Any other technique now known or later developed for transferring charge to the ablated printing materials is further contemplated as well.

In some embodiments, the charger 140 may include two or more electrodes separated by a dielectric barrier. For instance, one or both of the electrodes may be covered with the dielectric barrier material and separated from one another by a gap so that the ablated printing materials can pass through the gap between the electrodes. An AC signal, or in some cases a DC signal, may be applied across the electrodes. At sufficiently high voltages, applying the signal to the electrodes may cause charges to collect on the surface of the dielectric material and discharge across the gap between the electrodes. As a result of these discharges, ions may collide with and transfer charge to the ablated printing material particles, thereby charging the ablated printing material particles.

In other embodiments, the charger 140 may include a charging tunnel, such as those used in continuous inkjet printers, and as the ablated printing material particles pass through the charging tunnel, the charging tunnel may electrostatically charge the ablated printing material particles.

In practice, the charger 140 may generate a plasma for charging the ablated printing material particles. For instance, the charger 140 may generate a DC plasma corona by biasing an electrode with a DC voltage that is sufficiently high for the electric field to ionize gas particles near the electrode. Alternatively, the charger 140 may include capacitive electrodes for generating a capacitively-coupled RF plasma, or the charger 140 may include an inductive coil for an inductively-coupled RF plasma. Applying an RF signal to the capacitive electrodes or the inductive coil exposes nearby gas particles to a time-varying electric field that ionizes the gas particles. In any case, the gas particles ionized by the charger 140 may collide with the ablated printing material particles, and these collisions may transfer an electric charge to the ablated printing material particles. As such, after passing through the charger 140, the ablated particles include charged printing material particles.

The charged printing material particles may then advance from the charger 140 to the accelerator/collimator 150, as depicted by arrow 145. In some embodiments, the charged printing material particles may be electrostatically accelerated toward to the accelerator/collimator 150. For instance, in examples where the charger 140 generates a DC plasma, the electric field generated by the DC voltage may be oriented toward the accelerator/collimator 150, so that the charged printing material particles travel along the electric field lines toward the accelerator/collimator 150. In examples, where the charger 140 generates an RF plasma, an additional DC voltage may be applied to one or more electrodes of the charger 140 in order to generate an electric field in which the field lines are oriented toward the accelerator/collimator 150.

The accelerator/collimator 150 may be configured to accelerate the charged printing material particles toward the printing substrate 160, as depicted by arrow 155, and may also be configured to collimate or otherwise beamform the charged printing material particles. To facilitate this, the accelerator/collimator 150 may include one or more electrostatic deflectors, which, when electrically biased, electrostatically deflect the charged printing material particles in one or more directions. As such, the accelerator/collimator 150 may electrically bias the electrostatic deflectors to deflect the charged printing material particles into a collimated beam and toward the printing substrate 160.

In some embodiments, the accelerator/collimator 150 may include multiple sets of deflectors. For instance, the accelerator/collimator 150 may include both a first set of deflectors configured to deflect the charged printing material particles along a horizontal direction (e.g., along an x-axis of the printing substrate 160) and a second set of deflectors configured to deflect the charged printing material particles along a vertical direction (e.g., along a y-axis of the printing substrate 160).

The accelerator/collimator 150 may use the electrostatic deflectors to guide the charged printing material particles to one or more particular locations on the printing substrate 160. For instance, the accelerator/collimator 150 may use the electrostatic deflectors to guide the charged printing material particles toward the printing substrate 160 in a particular pattern, so that when the printing material particles collide with, and are deposited on, the printing substrate 160, the printing material particles form an image. In this manner, the printing system 100 may act as a printer that uses laser ablation to reproduce a predetermined image on the printing substrate 160.

As further shown in FIG. 1, at least some of the components of the printing system 100 may be arranged within a vacuum chamber 170. For instance, as shown, the printing material 130, the charger 140, the accelerator/collimator 150, and the printing substrate 160 are arranged within the vacuum chamber 170. However, in other embodiments, additional or fewer components may be arranged within the vacuum chamber 170. The vacuum chamber 170 may contain gas at a pressure below atmospheric pressure (e.g., between 10 mTorr and 2000 mTorr), which may provide improved conditions for the charger 140 to generate a plasma for charging ablated printing material particles. For instance, lowering the pressure of the gas to a particular pressure range may significantly reduce the strength of the electric field needed to ionize the gas. The pressure of the vacuum chamber 170 may depend on the gas within the vacuum chamber 170, as different gases are more easily ionized at different pressures. In some embodiments, the gas may be an inert gas, such as argon, helium, or neon, so as to reduce or avoid unwanted chemical reactions between the gas and the components arranged in the vacuum chamber 170.

In operation, the controller 110 may determine an image that is to be reproduced by the printing system 100. For instance, the image may be a digital image, and the controller 110 may receive data representing the digital image, such as one or more page description language (PDL) objects that identify how graphics and/or text is to be printed. In some examples, the controller 110 may determine the image that is to be printed by receiving a digital file, such as an image file (e.g., TIFF, GIF, PNG, JPEG) or another type of digital file (e.g., DOCX, XLSX, PPTX, PDF), and converting the received digital file into PDL format.

In any case, the digital image may include a number of pixels each having a particular color, and the controller 110 may use data representing the image, such as a PDL object or some other digital file, to determine the color value of the pixels. Based on the determined color of a particular pixel, the controller 110 may cause the laser 120 to ablate a particular surface area of the printing material 130. As noted above, for instance, the printing material 130 may include multiple printing materials 130*a-c* of different colors. As such, if the controller 110 determines that a pixel has a color value that corresponds to a color of printing material 130*a*, then the controller 110 may responsively cause the laser 120 to ablate printing material 130*a*. To facilitate this, the laser 120 may be equipped with scanning mirrors or some other scanning optics for steering the laser beam 125. As such, in the present example, the controller 110 may adjust the scanning optics to steer the laser beam 125 toward printing material 130*a*.

In some embodiments, the controller 110 may cause the laser 120 to ablate multiple ones of the printing materials 130*a-b* based on the color value of the pixel. For instance, if the color value of the pixel does not directly correspond to a color of one of the printing materials 130*a-c*, but instead corresponds to a mixture of colors of the printing materials 130*a-c*, then the controller 110 may cause the laser 120 to ablate multiple ones of the printing materials 130*a-c* in order to print the pixel color corresponding to the mixture. For instance, similar to traditional ink-based printers, the printing material 130 may include a cyan printing material, a magenta printing material, a yellow printing material, and a black printing material, so that the pixel colors can be reproduced on the printing substrate 160 according to the CMYK color model. In such an example, the color of the pixel can be reproduced on the printing substrate 160 by controlling how much material is ablated from each of the cyan, magenta, yellow, and black printing materials, for instance by controlling how long the laser 120 ablates each printing material.

In some embodiments, the controller 110 may cause the laser 120 to ablate a particular surface area of the printing material 130 based on other information, either in addition or in the alternative to the color value of a pixel. As noted above, for instance, the printing material 130 may include various different composition types, including ceramic materials, metallic materials, and intermetallic materials. As such, when printing one or more pixels of the image, the printing system 100 may be configured to ablate a printing material having a particular composition type. In some embodiments, the data representing the image may include metadata specifying a composition type for some or all of the pixels, and the controller 110 may cause the laser 120 to ablate a particular printing material 130 based on the metadata. For instance, the metadata may indicate that a particular pixel is associated with a metallic material. As such, when printing that particular pixel, the controller 110 may cause the laser 120 to ablate a metallic portion of the printing material 130.

The charger 140 may charge the ablated particles from printing material 130*a*, as described above, and the accelerator/collimator 150 may deflect the charged particles toward the printing substrate 160. In particular, the accelerator/collimator 150 may deflect the charged particles toward a particular location on the printing substrate 160 that corresponds to a location of the pixel in the digital image. For instance, if the pixel corresponds to the top leftmost corner of the digital image, then the accelerator/collimator 150 may deflect the charged particles toward the top leftmost corner of the printing substrate 160, within any predefined margins of the printing substrate 160. To facilitate this, the accelerator/collimator 150 may collimate the charged particles into a beam, as described above, and may deflect the beam along one or more axes (e.g., along an x-axis and a y-axis) so that the beam is incident on the printing substrate 160 at its top leftmost corner. The charged particles from printing material 130*a* are then deposited on the printing substrate 160 at its top leftmost corner, thereby printing a representation of the pixel onto the printing substrate 160. This process may be repeated for each remaining pixel in the digital image until the entire image is reproduced on the printing substrate 160.

Figure 2A:
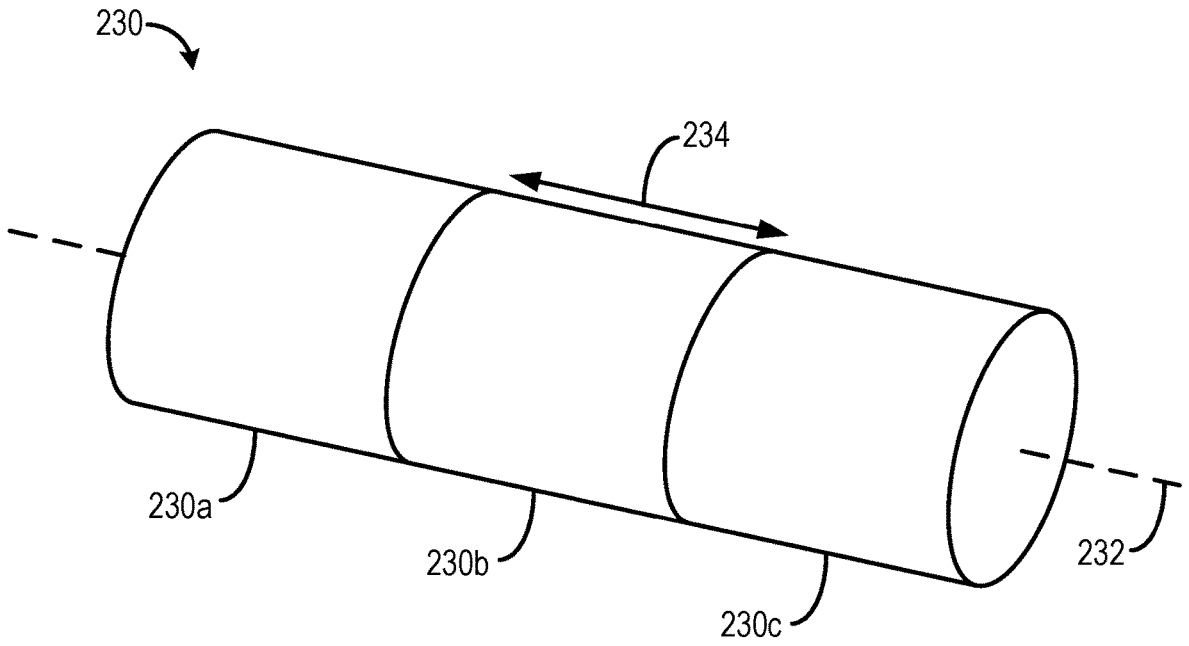
FIG. 2A is a simplified drawing of a printing material for use in connection with the printing system depicted in FIG. 1, according to an example embodiment.
Figure 2B:
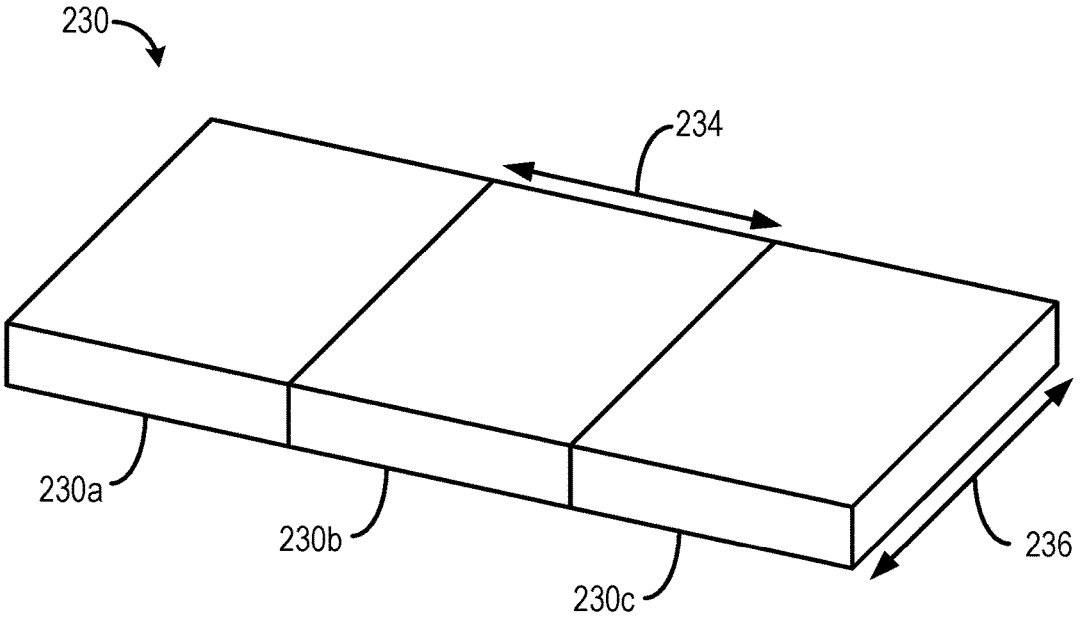
FIG. 2B is a simplified drawing of a printing material for use in connection with the printing system depicted in FIG. 1, according to an example embodiment.

FIGS. 2A and 2B next illustrate example embodiments of a printing material 230 for use in connection with the printing system 100. Printing material 230 may be similar to or the same as printing material 130 depicted in FIG. 1. For instance, as described above in connection with printing material 130, printing material 230 may include multiple printing materials 230*a-c*, each having a particular color or type.

As shown in FIG. 2A, the printing material 230 may be cylindrical in shape, having a center axis 232 extending along a length of the printing material 230. The cylindrical printing material 230 may be coupled to a motor configured to rotate the printing material 230 around its center axis 232. For instance, when the laser 120 is ablating the printing material 230, the controller 110 may cause the motor to rotate the printing material 230 around its center axis 232. This may result in a more uniform ablation of the printing material 230 over time, as the laser 120 would not repeatedly ablate the same spot on the printing material 230.

Similarly, the laser 120 may be configured to scan the length of the printing material 230 when ablating the printing material 230. For instance, when ablating printing material 230*b*, the controller 110 may cause the laser 120 to scan a length 234 of printing material 230*b*, so that printing material 230*b* is ablated more uniformly along its length. As noted above, the laser 120 may be equipped with scanning mirrors or some other scanning optics for steering the laser beam 125. As such, the controller 110 may use these scanning optics to scan the laser beam 125 along the length of the printing material 230.

The printing material 230 may take other forms as well. For instance, as shown in FIG. 2B, the printing material 230 may be rectangular in shape. In order to more uniformly ablate the rectangular printing material 230, the laser 120 may be configured to scan the printing material 230 along its length and width. For instance, when ablating printing material 230*b*, the controller 110 may cause the laser 120 to scan the laser beam 125 along the length 234 and the width 236 of printing material 230*b*.

Figure 3:
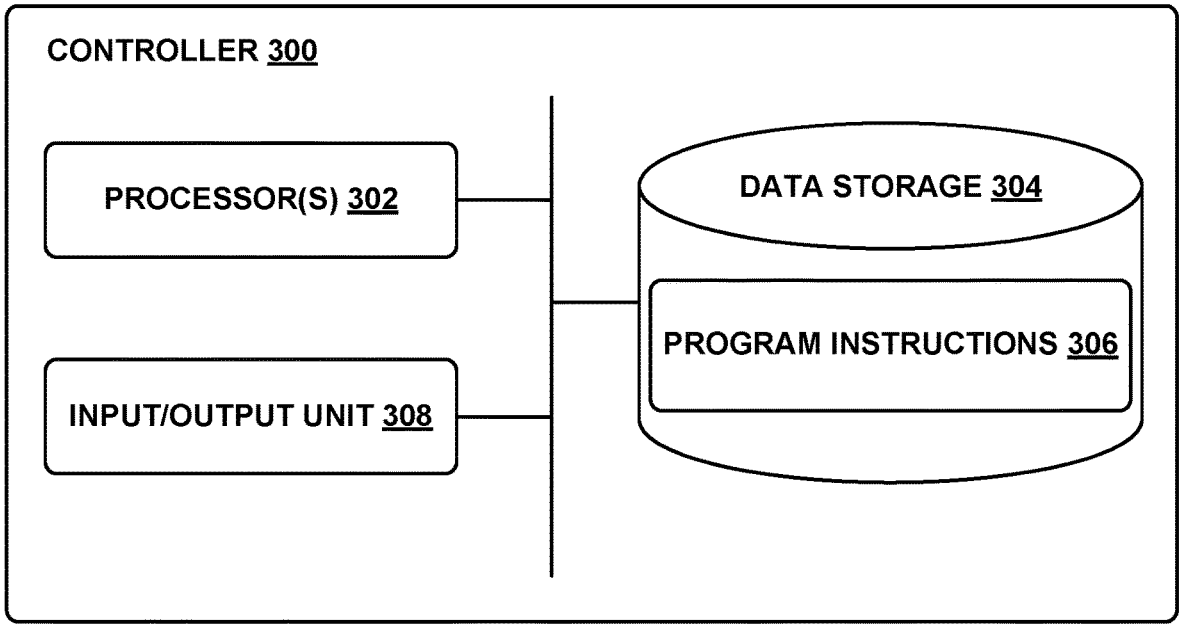
FIG. 3 is a block diagram of a controller for use in connection with the printing system depicted in FIG. 1, according to an example embodiment.

In order to carry out the methods, processes, or functions disclosed in this specification or the accompanying drawings, the controller 110 and/or various other components of the printing system 100 may include various computing device components. FIG. 3 depicts an example embodiment of computing device components 300 (e.g., functional elements of a computing device) that may be included in the controller 110 and/or other components of the printing system 100.

The computing device components 300 may include one or more processors 302, data storage 304, program instructions 306, and an input/output unit 308, all of which may be coupled by a system bus or a similar mechanism. The one or more processors 302 may include one or more central processing units (CPUs), such as one or more general purpose processors and/or one or more dedicated processors (e.g., application specific integrated circuits (ASICs) or digital signal processors (DSPs), etc.). The one or more processors 302 can be configured to execute computer-readable program instructions 306 that are stored in the data storage 304 and are executable to provide at least part of the functionality described herein.

The data storage 304 may include or take the form of one or more computer-readable storage media that may be read or accessed by at least one of the one or more processors 302. The one or more computer-readable storage media can include volatile and/or non-volatile storage components, such as optical, magnetic, organic, or other memory or disc storage, which may be integrated in whole or in part with at least one of the one or more processors 302. In some embodiments, the data storage 304 may be implemented using a single physical device (e.g., one optical, magnetic, organic, or other memory or disc storage unit), while in other embodiments, the data storage 304 may be implemented using two or more physical devices.

The input/output unit 308 may include user input/output devices, network input/output devices, and/or other types of input/output devices. For example, the input/output unit 308 may include user input/output devices, such as a touch screen, a keyboard, a keypad, a computer mouse, liquid crystal displays (LCD), light emitting diodes (LEDs), displays using digital light processing (DLP) technology, cathode ray tubes (CRT), light bulbs, and/or other similar devices. Network input/output devices may include wired network receivers and/or transceivers, such as an Ethernet transceiver, a Universal Serial Bus (USB) transceiver, or similar transceiver configurable to communicate via a twisted pair wire, a coaxial cable, a fiber-optic link, or a similar physical connection to a wireline network, and/or wireless network receivers and/or transceivers, such as a Bluetooth transceiver, a Zigbee transceiver, a Wi-Fi transceiver, a WiMAX transceiver, a wireless wide-area network (WWAN) transceiver and/or other similar types of wireless transceivers configurable to communicate via a wireless network.

The computing device components 300 may be implemented in whole or in part in various components of the printing system 100 depicted in FIG. 1 and/or in at least one device remotely located from the printing system 100, such as a workstation or personal computer. Generally, the manner in which the computing device components 300 are implemented may vary, depending upon the particular application.

Figure 4:
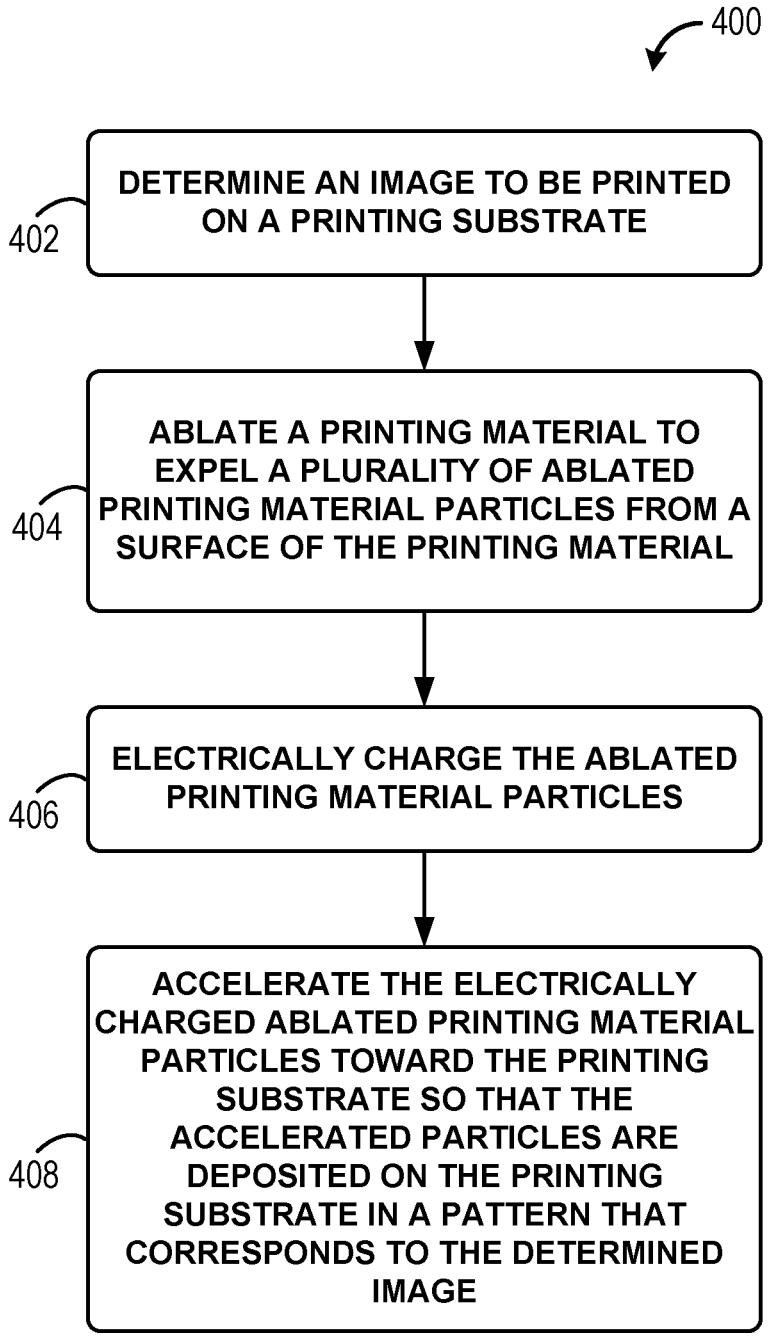
FIG. 4 is a flowchart of a method, according to an example embodiment.
Figure 5:
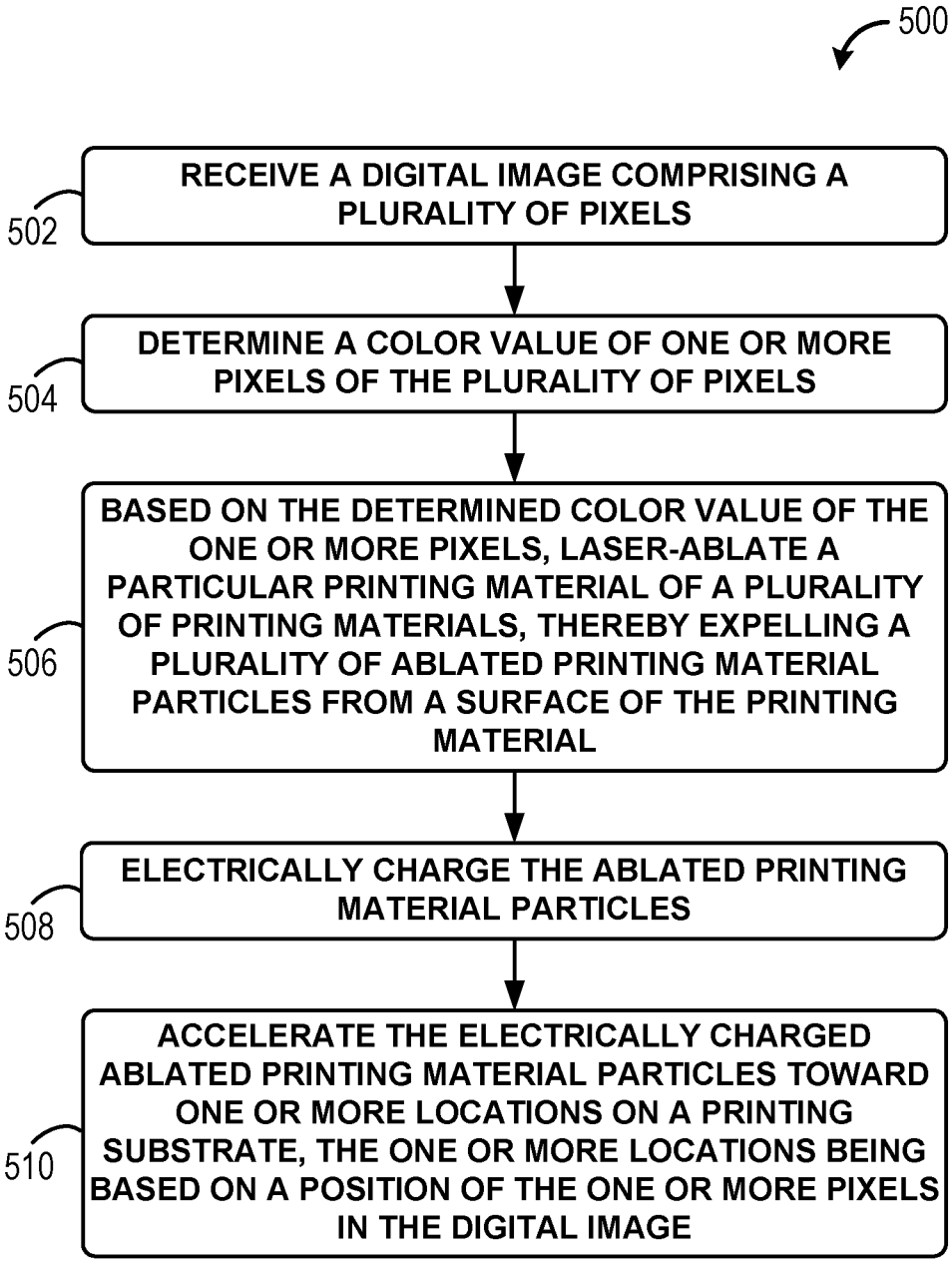
FIG. 5 is a flowchart of another method, according to an example embodiment.

FIGS. 4 and 5 depict flowcharts of example methods 400, 500 that could be carried out in connection with one or more of the printing systems described herein. The example methods 400, 500 may include one or more operations, functions, or actions, as depicted by one or more of blocks 402, 404, 406, 408, 502, 504, 506, 508, and/or 510, each of which may be carried out by any of the systems described by way of FIGS. 1-3; however, other configurations could be used as well.

Furthermore, those skilled in the art will understand that the flowchart described herein illustrates functionality and operation of certain implementations of example embodiments. In this regard, each block of the flow diagram may represent a module, a segment, or a portion of program code, which includes one or more instructions executable by a processor for implementing specific logical functions or steps in the process. The program code may be stored on any type of computer readable medium, for example, such as a storage device including a disk or hard drive. In addition, each block may represent circuitry that is wired to perform the specific logical functions in the process. Alternative implementations are included within the scope of the example embodiments of the present application in which functions may be executed out of order from that shown or discussed, including substantially concurrent or in reverse order, depending on the functionality involved, as would be understood by those reasonably skilled in the art.

Referring to FIG. 4, method 400 begins at block 402, which includes determining an image to be printed on a printing substrate. In line with the discussion above, the image may be a digital image, and determining the image to be printed may involve receiving, from a computing device, data representing the digital image, such as a PDL object, an image file, or some other digital file.

Method 400 continues at block 404, which includes ablating a printing material to expel a plurality of ablated printing material particles from a surface of the printing material. In line with the discussion above, the printing material may include one or more solid materials, such as a ceramic, a metal, or an intermetallic material, and/or the printing material may include one or more liquid materials, such as an ink. Further, ablating the printing material particles from the surface of the printing material may involve laser ablating the printing material particles by irradiating the surface of the printing material with a laser beam.

Method 400 continues at block 406, which includes electrically charging the ablated printing material particles. In line with the discussion above, electrically charging the ablated printing material particles may involve exposing the ablated printing material particles to an RF discharge, a microwave discharge, or a corona discharge.

Method 400 continues at block 408, which includes accelerating the electrically charged ablated printing material particles toward the printing substrate so that the accelerated particles are deposited on the printing substrate in a pattern that corresponds to the determined image. In embodiments where the image is a digital image that includes a number of pixels, accelerating the electrically charged ablated printing material particles toward the printing substrate may involve accelerating the particles toward particular locations on the printing substrate that correspond to particular pixels of the digital image.

In some embodiments, ablating the printing material may involve (i) determining a color value of a first pixel of the digital image and (ii) based on the color value of the first pixel, ablating a first printing material having a first color that corresponds to the color value of the first pixel. Accelerating the electrically charged ablated printing material particles toward the printing substrate may involve accelerating the ablated first printing material toward a first location on the printing substrate that corresponds to the first pixel. Ablating the printing material may further involve (i) determining a color value of a second pixel of the digital image and (ii) based on the color value of the second pixel, ablating a second printing material having a second color that corresponds to the color value of the second pixel. Accelerating the electrically charged ablated printing material particles toward the printing substrate may further involve accelerating the ablated second printing material toward a second location on the printing substrate that corresponds to the second pixel.

Referring next to FIG. 5, method 500 begins at block 502, which includes receiving a digital image comprising a plurality of pixels. In line with the discussion above, this may involve receiving data representing the digital image, including a PDL object, an image file, or some other digital file.

Method 500 continues at block 502, which includes determining a color value of one or more pixels of the plurality of pixels. In line with the discussion above, the color value of the pixels may be determined from the PDL object, image file, or some other digital file that represents the digital image.

Method 500 continues at block 504, which includes, based on the determined color value of the one or more pixels, laser-ablating a particular printing material of a plurality of printing materials, thereby expelling a plurality of ablated printing material particles from a surface of the printing material. In line with the discussion above, this may involve laser-ablating a particular printing material having a color that corresponds to the color value of the pixel, or this may involve laser-ablating multiple printing materials to produce multiple colors of ablated printing material particles that combine to form the color that corresponds to the color value of the pixel.

Method 500 continues at block 508, which includes electrically charging the ablated printing material particles. In line with the discussion above, electrically charging the ablated printing material particles may involve exposing the ablated printing material particles to an RF discharge, a microwave discharge, or a corona discharge.

Method 500 continues at block 510, which includes accelerating the electrically charged ablated printing material particles toward one or more locations on a printing substrate, the one or more locations being based on a position of the one or more pixels in the digital image.

In addition to the operations depicted in FIGS. 4 and 5, other operations may be utilized with the example printing systems presented herein.

III. Conclusion

The particular arrangements shown in the Figures should not be viewed as limiting. It should be understood that other embodiments may include more or less of each element shown in a given Figure. Further, some of the illustrated elements may be combined or omitted. Yet further, example embodiments may include elements that are not illustrated in the Figures.

Additionally, while various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are contemplated herein.

What is claimed is:

1. A method comprising:

determining an image to be printed on a printing substrate;

causing a laser to ablate a printing material to expel a plurality of ablated printing material particles from a surface of the printing material;

causing a charging electrode to electrically charge the ablated printing material particles; and causing a plurality of electrostatic deflectors, including a first electrostatic deflector and a second electrostatic deflector, to accelerate the electrically charged ablated printing material particles toward the printing substrate so that the accelerated particles are deposited on the printing substrate in a pattern that corresponds to the determined image, wherein causing the plurality of electrostatic deflectors to accelerate the electrically charged ablated printing material particles comprises (i) causing the first electrostatic deflector to deflect the electrically charged ablated printing material particles along a first axis and (ii) causing the second electrostatic deflector to deflect the electrically charged ablated printing material particles along a second axis orthogonal to the first axis.

2. The method of claim 1, wherein the image is a digital image comprising a plurality of pixels, and wherein causing the plurality of electrostatic deflectors to accelerate the electrically charged ablated printing material particles toward the printing substrate comprises causing the plurality of electrostatic deflectors to accelerate the particles toward particular locations on the printing substrate that correspond to particular pixels of the plurality of pixels.

3. The method of claim 2, wherein the printing material comprises a first printing material of a first color and a second printing material of a second color, wherein causing the laser to ablate the printing material comprises (i) determining a color value of a first pixel of the plurality of pixels and (ii) based on the color value of the first pixel, causing the laser to ablate the first printing material of the first color, and wherein causing the plurality of electrostatic deflectors to accelerate the electrically charged ablated printing material particles toward the printing substrate comprises causing the plurality of electrostatic deflectors to accelerate the ablated first printing material toward a first location on the printing substrate that corresponds to the first pixel.

4. The method of claim 3, wherein causing the laser to ablate the printing material further comprises (i) determining a color value of a second pixel of the plurality of pixels and (ii) based on the color value of the second pixel, causing the laser to ablate the second printing material of the second color, and wherein causing the plurality of electrostatic deflectors to accelerate the electrically charged ablated printing material particles toward the printing substrate further comprises causing the plurality of electrostatic deflectors to accelerate the ablated second printing material toward a second location on the printing substrate that corresponds to the second pixel.

5. The method of claim 1, wherein causing the charging electrode to electrically charge the ablated printing material particles comprises causing the charging electrode to produce a corona discharge, thereby exposing the ablated printing material particles to the corona discharge.

6. The method of claim 1, further comprising causing the plurality of electrostatic deflectors to collimate the electrically charged ablated printing material particles into a beam of electrically charged ablated printing material particles.

7. The method of claim 1, wherein the printing material is a solid printing material, and wherein the printing material is cylindrical or rectangular in shape.

8. The method of claim 1, wherein at least the printing material and the printing substrate are arranged in a pressurized housing, and wherein the method further comprises reducing a pressure of the pressurized housing to between 10 mTorr and 2000 mTorr.

9. A system comprising:

a printing substrate;

a printing material;

a laser;

a charging electrode;

a plurality of electrostatic deflectors comprising a first electrostatic deflector and a second electrostatic deflector;

one or more processors; and a non-transitory computer-readable medium having stored thereon program instructions that, upon execution by the one or more processors, cause performance of a set of operations comprising:

determining an image to be printed on the printing substrate;

causing the laser to ablate the printing material, thereby expelling a plurality of ablated printing material particles from a surface of the printing material;

causing the charging electrode to electrically charge the ablated printing material particles; and causing the plurality of electrostatic deflectors to accelerate the electrically charged ablated printing material particles toward the printing substrate so that the accelerated particles are deposited on the printing substrate in a pattern that corresponds to the determined image, wherein causing the plurality of electrostatic deflectors to accelerate the electrically charged ablated printing material particles comprises (i) causing the first electrostatic deflector to deflect the electrically charged ablated printing material particles along a first axis and (ii) causing the second electrostatic deflector to deflect the electrically charged ablated printing material particles along a second axis orthogonal to the first axis.

10. The system of claim 9, wherein the image is a digital image comprising a plurality of pixels, and wherein causing the plurality of electrostatic deflectors to accelerate the electrically charged ablated printing material particles toward the printing substrate comprises causing the plurality of electrostatic deflectors to accelerate the particles toward particular locations on the printing substrate that correspond to particular pixels of the plurality of pixels.

11. The system of claim 10, wherein the printing material comprises a first printing material of a first color and a second printing material of a second color, wherein causing the laser to ablate the printing material comprises (i) determining a color value of a first pixel of the plurality of pixels and (ii) based on the color value of the first pixel, causing the laser to ablate the first printing material of the first color, and wherein causing the plurality of electrostatic deflectors to accelerate the electrically charged ablated printing material particles toward the printing substrate comprises causing the plurality of electrostatic deflectors to accelerate the ablated first printing material toward a first location on the printing substrate that corresponds to the first pixel.

12. The system of claim 11, wherein causing the laser to ablate the printing material further comprises (i) determining a color value of a second pixel of the plurality of pixels and (ii) based on the color value of the second pixel, causing the laser to ablate the second printing material of the second color, and wherein causing the plurality of electrostatic deflectors to accelerate the electrically charged ablated printing material particles toward the printing substrate further comprises causing the plurality of electrostatic deflectors to accelerate the ablated second printing material toward a second location on the printing substrate that corresponds to the second pixel.

13. The system of claim 9, wherein the charging electrode is configured to produce a corona discharge, and wherein causing the charging electrode to electrically charge the ablated printing material particles comprises causing the charging electrode to produce the corona discharge, thereby exposing the ablated printing material particles to the corona discharge.

14. The system of claim 9, further comprising a collimator, the set of operations further comprising: causing the collimator to collimate the electrically charged ablated printing material particles into a beam of electrically charged ablated printing material particles.

15. The system of claim 9, further comprising a pressurized housing, wherein at least the printing material and the printing substrate are arranged in the pressurized housing, and wherein the set of operations further comprises reducing a pressure of the pressurized housing to between 10 mTorr and 2000 mTorr.

16. A method comprising:

receiving a digital image comprising a plurality of pixels; and for one or more pixels of the plurality of pixels, performing a laser-ablation printing process comprising:

determining a color value of the one or more pixels;

based on the determined color value of the one or more pixels, laser-ablating a particular printing material of a plurality of printing materials, thereby expelling a plurality of ablated printing material particles from a surface of the particular printing material;

electrically charging the ablated printing material particles; and causing a plurality of electrostatic deflectors, including a first electrostatic deflector and a second electrostatic deflector, to accelerate the electrically charged ablated printing material particles toward one or more locations on a printing substrate, wherein the one or more locations on the printing substrate are based on a position of the one or more pixels in the digital image, and wherein causing the plurality of electrostatic deflectors to accelerate the electrically charged ablated printing material particles comprises (i) causing the first electrostatic deflector to deflect the electrically charged ablated printing material particles along a first axis and (ii) causing the second electrostatic deflector to deflect the electrically charged ablated printing material particles along a second axis orthogonal to the first axis.

17. The method of claim 1, wherein causing the charging electrode to electrically charge the ablated printing material particles includes causing the charging electrode to generate a plasma for charging the ablated printing material particles.

18. The method of claim 2, wherein the printing material comprises a first printing material of a first color and a second printing material of a second color, wherein causing the laser to ablate the printing material comprises (i) determining a color value of a pixel of the plurality of pixels, (ii) determining that the color value of the pixel corresponds to a mixture of colors including the first color and the second color, and (iii) causing the laser to ablate the first printing material of the first color, and wherein causing the plurality of electrostatic deflectors to accelerate the electrically charged ablated printing material particles toward the printing substrate comprises causing the plurality of electrostatic deflectors to accelerate both the ablated first printing material and the ablated second printing material toward a location on the printing substrate that corresponds to the pixel.

19. The method of claim 7, wherein the printing material is cylindrical in shape with a center axis extending along a length of the printing material, and wherein causing the laser to ablate the printing material comprises:

causing the laser to ablate different areas of the printing material by (i) rotating the printing material around the center axis and (ii) causing the laser to scan a laser beam at least partially along the length of the printing material.

20. The method of claim 7, wherein the printing material is rectangular in shape, and wherein causing the laser to ablate the printing material comprises:

causing the laser to ablate different areas of the printing material by scanning a laser beam at least partially along a width and a length of the printing material.

* * * * *